US006641709B2

(12) United States Patent
Okase et al.

(10) Patent No.: US 6,641,709 B2
(45) Date of Patent: Nov. 4, 2003

(54) MIST TRAP MECHANISM AND METHOD FOR PLATING APPARATUS

(75) Inventors: Wataru Okase, Nirasaki (JP); Koichiro Kimura, Nirasaki (JP); Takenobu Matsuo, Tosu (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 10/290,293

(22) Filed: Nov. 8, 2002

(65) Prior Publication Data

US 2003/0094372 A1 May 22, 2003

(30) Foreign Application Priority Data

Nov. 8, 2001 (JP) ..... 2001-342802

(51) Int. Cl.[7] ..... C25D 17/00

(52) U.S. Cl. ..... 205/94; 204/278; 204/279; 205/123

(58) Field of Search ..... 205/94, 123, 157; 204/278, 279

(56) References Cited

U.S. PATENT DOCUMENTS 4,075,069 A * 2/1978 Shinohara et al. ..... 204/106
5,223,119 A * 6/1993 Davies ..... 205/94
5,744,018 A * 4/1998 Santoyo et al. ..... 205/94
5,855,749 A * 1/1999 Kohut et al. ..... 204/270
5,997,711 A * 12/1999 Bourke ..... 205/94
6,120,658 A * 9/2000 Dunn et al. ..... 204/279
6,214,193 B1 4/2001 Reid et al.

* cited by examiner

*Primary Examiner*—Roy King
*Assistant Examiner*—William T. Leader
(74) *Attorney, Agent, or Firm*—Pillsbury Winthrop LLP

(57) ABSTRACT

A mist trap mechanism and method for a plating apparatus, which can provide an improved mist removing effect by a simple structure, are provided. A gas discharge passage is formed to connect the space in a plating chamber and space outside of the plating chamber and provided with a liquid spouting portion and a solid wall. The discharge gas collides with the liquid spouted from the liquid spouting portion, and the discharge gas collides with the solid wall which has its surface wetted with the liquid spouted from the liquid spouting portion. Such a two-staged collision of the discharge gas effectively takes the mist contained in the discharge gas into the liquid. A liquid recovery portion is disposed in connection with the gas discharge passage to collectively catch the mist in a state captured by the liquid.

6 Claims, 3 Drawing Sheets

MIST TRAP MECHANISM AND METHOD FOR PLATING APPARATUS

BACKGROUND OF THE INVENTION

1. Field of the Invention

The present invention relates to a mist trap mechanism and method for a plating apparatus for removing a mist from an atmosphere which is discharged from a plating space, and particularly a mist trap mechanism and method for a plating apparatus, which are suitable for improvement of a mist removing effect.

2. Description of the Related Art

In production of a semiconductor device or a flat-panel display device, there is used a process for forming a film of copper (Cu), which is a wiring material, by plating in order to form fine wiring on a subject substrate such as a semiconductor wafer, a glass substrate or the like.

Such a plating process is performed by filling a plating solution, e.g., an aqueous solution containing $CuSO_4$ as a base, into a plating solution bath and immersing the subject substrate, which is previously formed a thin film layer (seed layer) as a seed for plating, into the plating solution.

In addition to $CUSO_4$, the plating solution generally includes $H_2SO_4$ which increases conductivity to finely pass a plating current so to make efficient plating and an additive for plating uniformly so to maintain the quality. Therefore, the plating solution is generally high in corrosion because of $H_2SO_4$ included.

Therefore, a general apparatus for plating is provided with a processing space which surrounds the plating solution bath to shut off from the outside atmosphere. Thus, a mist of corrosive plating solution or scattered plating solution resulting from the plating solution filled in the plating solution bath is kept in the processing space and prevented from diffusing to the outside.

However, even if the mist of plating solution is simply held in the processing space, the atmosphere in the processing space is degraded and a trouble is caused in the processing or the apparatus. Specifically, the mist of plating solution becomes a contamination source to the subject substrate when the subject substrate is through the plating process and pulled upward and held above the plating solution bath.

The mist of plating solution has an effect on a dry contact for performing electrical contact with the subject substrate, which is disposed on a subject substrate holder which holds the subject substrate, immerses it in the plating solution bath and takes off it from the plating solution bath. Specifically, a surface of the dry contact is corroded with the mist of plating solution in the processing space and the corroded surface becomes a cause of increasing a contact resistance. Besides, the mist of plating solution adheres to the inside surface or the like which forms the processing space to produce deposition or the like of $CuSO_4$ and to increase a load of maintenance.

To remedy such defects and to keep the atmosphere in the processing space clean, a gas discharge portion for discharging the atmosphere from the processing space is generally disposed. From the viewpoint of the prevention of the corrosive substance from diffusing to the outside, this gas discharge portion is desired to remove the mist of plating solution, which is contained in the discharge gas, in an amount as large as possible.

However, to effectively remove the mist of plating solution which is contained in the atmosphere discharged from the processing space, it is generally necessary to adopt a method which uses a large amount of liquid for dissolving the mist and separating it from a gas such as air and passes the discharge gas through the liquid so that its contact area with the liquid becomes large. This method requires a large-scale apparatus, which is not suitably fitted to the plating apparatus.

SUMMARY OF THE INVENTION

The present invention was achieved in view of the above circumstances. It is an object of the invention to provide a mist trap mechanism and method for a plating apparatus, which remove a mist from the atmosphere to be discharged from a plating space, wherein a mist removing effect can be improved by a simple structure.

To achieve the above object, a mist trap mechanism for the plating apparatus according to the present invention comprises a gas discharge passage which runs from a space in a plating chamber to a space outside the plating chamber; a liquid spouting portion which is disposed in the gas discharge passage and spouts a liquid to be collided with a stream of gas being discharged; a solid wall which is disposed in the gas discharge passage in such a way that its surface gets wet with the spouted liquid and the wet surface collides with the stream of discharge gas; and a liquid recovery portion which is disposed in connection with the gas discharge passage and recovers the spouted liquid, the liquid collided with the stream of gas and the liquid having wetted the surface of the solid wall.

The gas discharge passage is disposed to connect the space in the plating chamber and the space outside the plating chamber. The gas discharge passage is provided with the liquid spouting portion and the solid wall, the discharge gas collides with the liquid spouted from the liquid spouting portion, and the discharge gas collides with the solid wall whose surface is wetted with the liquid spouted from the liquid spouting portion. Such a two-stage collision applied to the discharge gas allows effectively taking the mist contained in the discharge gas into the liquid. It is because the discharge gas is passed through the gas discharge passage which is a passage having a limited size, and the aforesaid collision gives a large impact to the discharge gas. Besides, the liquid recovery portion which is disposed in connection with the gas discharge passage allows collectively catching the mist in a state taken into the liquid.

Therefore, the mist removing effect in the processing space can be improved by a simple structure, and when the mist trap mechanism is fitted to the plating apparatus, its mounting position can be selected with high flexibility.

The mist trap method for a plating apparatus according to the present invention comprises discharging a gas from a space in a plating chamber to a space outside the plating chamber through a gas discharge passage; colliding liquid spouted from a liquid spouting portion, which is disposed in the gas discharge passage, with a stream of the discharge gas; colliding the stream of the discharge gas with a solid wall which is disposed in the gas discharge passage and has its surface wetted with the spouted liquid; and recovering the spouted liquid, the liquid collided with the stream of gas and the liquid having wetted the surface of the solid wall.

This method has substantially the same function as that of the mist trap mechanism for the plating apparatus and can have substantially the same effect.

BRIEF DESCRIPTION OF THE DRAWINGS

The present invention will be described with reference to the accompanying drawings, and it is to be understood such drawings are provided for illustration only and do not restrict the present invention unless otherwise specified.

DETAILED DESCRIPTION OF THE INVENTION (Description of Embodiments)

According to the present invention, a liquid spouting portion and a solid wall are disposed in a gas discharge passage, the discharge gas collides with the liquid spouted from the liquid spouting portion, and the discharge gas collides with the solid wall whose surface gets wet with the liquid spouted from the liquid spouting portion. Such two-staged collision of the discharge gas effectively takes the mist, which is contained in the discharge gas, into the liquid. A liquid recovery portion is disposed in connection with the gas discharge passage to collectively catch the mist in a state contained in the liquid. Therefore, an effect of removing the mist from the processing space can be improved by a simple structure, and even when the mist trap mechanism is attached to the plating apparatus, its mounting position can be selected with high flexibility.

As an implementation mode of the present invention, the liquid spouting portion spouts pure water as the spouted liquid. Use of pure water can minimize the production of a side effect. In other words, it does not become another cause of contamination.

As an implementation mode of the present invention, the gas discharge passage has an opening having an annular shape to face the space in the plating chamber; and the liquid spouting portion is disposed to form an annular wall of liquid by the spouted liquid at the inner part of the annular opening of the gas discharge passage. Thus, the opening of the gas discharge passage can be entirely used to discharge the gas, and the annular wall of liquid can be faced to the entire gas discharged from the opening. Accordingly, the mist contained in the gas can be taken into the liquid more effectively.

As an implementation mode of the present invention, the liquid recovery portion is provided with a liquid storing portion which collectively stores the spouted liquid, the liquid collided with the gas stream and the liquid having wetted the surface of the solid wall; and a liquid discharge pipe which discharges the temporarily stored liquid when it overflows. Thus, the liquid containing the mist can be discharged easily.

As an implementation mode of the present invention, the solid wall has its surface, which gets wet with the spouted liquid, formed of any material such as PET (polyethylene terephthalate), PVC (polyvinyl chloride), PEEK (polyether ether ketone) and PVDF (polyvinylidene fluoride). Such resins exhibit wettability to the liquid such as pure water so to effectively contribute to the removal of mist from the colliding gas, and they are also advantageous in view of a service life because they are resistant to corrosion.

Embodiments of the present invention will be described with reference to the drawings.

Figure 1:
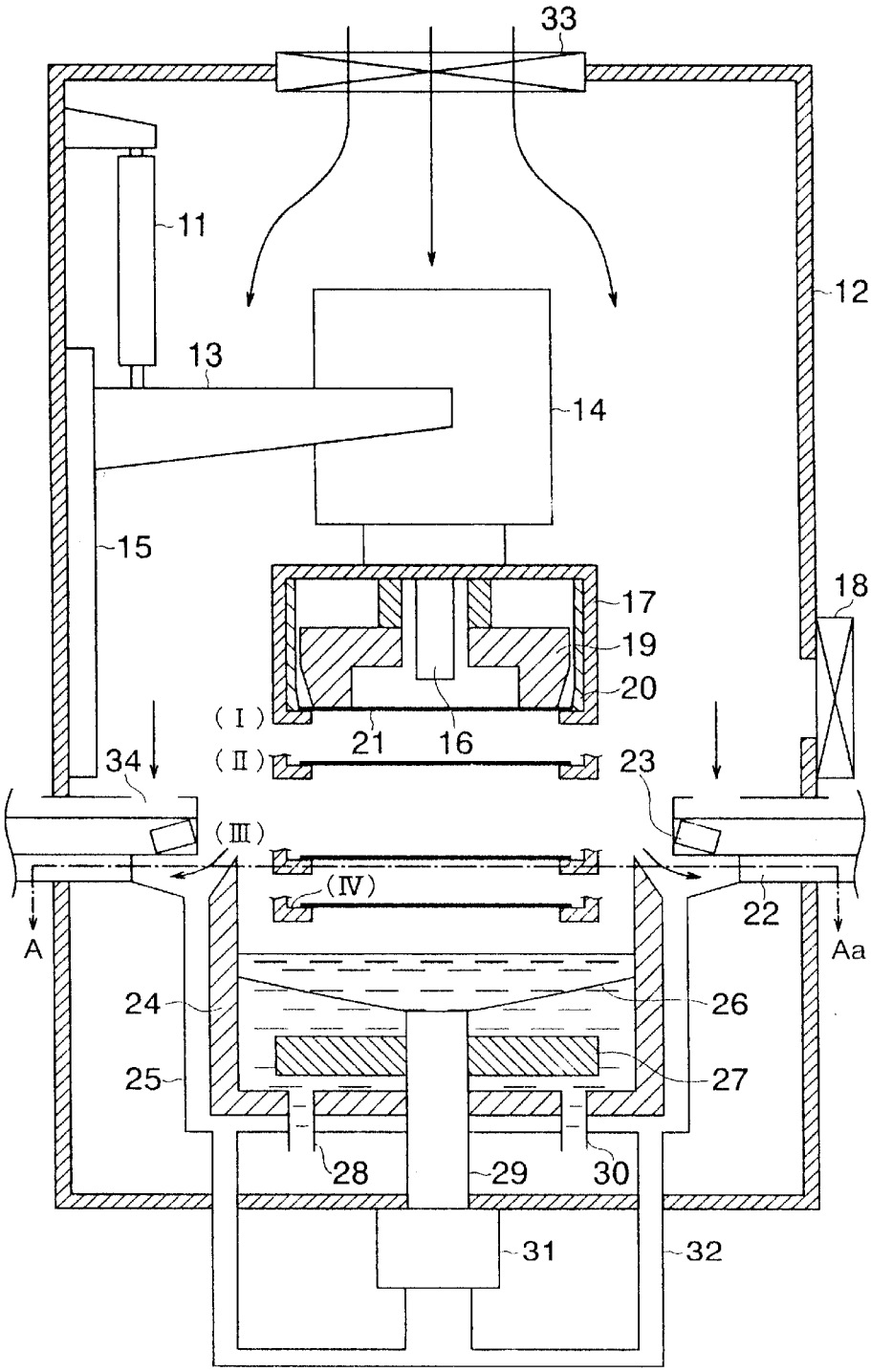
FIG. 1 is a front (partially sectional) view schematically showing a structure of the plating apparatus applied with one embodiment of the mist trap mechanism and mist trap method according to the present invention.

FIG. 1 is a front (partially sectional) view schematically showing a structure of the plating apparatus to which one embodiment of the mist trap mechanism and mist trap method according to the present invention is applied. First, the structure of the plating apparatus will be explained.

As shown in FIG. 1, this plating apparatus is entirely covered with a housing 12 having an airtight structure. This housing 12 is made of a material such as a synthetic resin or the like which is resistant to the plating solution.

The interior of the housing 12 has a two-storied structure, namely a first processing portion located on the lower stage and a second processing portion located on the upper stage. The first processing portion and the second processing portion are separated by a separator which includes washing nozzles 23 and exhaust ports 22 formed below the nozzles 23. A through hole is formed at the center of the separator in such a way that a wafer 21 being held by a wafer holding unit 17 can be traveled between the first processing portion and the second processing portion. The washing nozzles 23 are disposed in more than one in the circumferential direction of the through hole.

In the housing 12, a gate valve 18, which allows loading/unloading of the wafer 21 into/from the plating apparatus, is disposed a little above the boundary between the first processing portion and the second processing portion. The interior of the plating apparatus is isolated from the outside space when the gate valve 18 is closed, so that contamination is prevented from diffusing from the plating apparatus to the outside space.

A plating solution bath 24 is disposed in the first processing portion. The plating solution bath 24 is provided with an outside bath 25 which is concentrically disposed to accommodate the plating solution bath 24 in it. The plating solution bath 24 is fixed in such a manner that when the plating solution bath 24 is filled with the plating solution, a plating surface of the wafer 21 positioned at a plating position (IV) to be described later is lower than a level of the plating solution.

The plating solution bath 24 is formed to have an approximately cylindrical shape with a bottom, and an opening of the plating solution bath 24 is held substantially level. Inside the plating solution bath 24, an injection tube 29 which injects the plating solution from the bottom side of the plating solution bath 24 toward the top is protruded from about the center of the bottom of the plating solution bath 24 to reach about the middle of the depth of the plating solution bath 24. A substantially disk-shaped anode 27 is disposed about the injection tube 29 concentrically with the plating solution bath 24. The anode 27 is dissolved in the plating solution containing, for example, copper sulfate to keep a copper ion concentration constant in the plating solution.

A lead wire is routed from the anode 27 to an unshown external power supply which is disposed outside of the outside bath 25. The power supply is turned on to form an electric field between the anode 27 and the wafer 21.

A diaphragm 26 which divides the plating solution bath 24 into upper and lower portions is disposed above the anode 27 and between the outer edge at the end of the injection tube 29 and the plating solution bath 24. The plating solution is supplied through the injection tube 29 to the upper portion of the plating solution bath 24 (hereinafter called "the upper side of the plating solution bath") which is divided by the diaphragm 26, and the plating solution is supplied through a circulation pipe 28 to be described later to the lower portion (hereinafter called the "lower side of the plating solution bath") of the plating solution bath 24 which is divided by the diaphragm 26.

The diaphragm 26 is configured to allow permeation of ions but not to allow permeation of impurities produced when the anode 27 is dissolved and bubbles of, for example, oxygen and hydrogen produced on the plating surface of the wafer 21 during the plating operation. The circulation pipes 28, 30 are disposed off the center through the bottom of the plating solution bath 24, an unshown pump being disposed between these circulation pipes 28 and 30. The pump is operated to circulate the plating solution to the lower side of the plating solution bath 24.

The outside bath 25 is formed to have a substantially cylindrical shape having a bottom in the same way as the plating solution bath 24 and its top opening is kept substantially level. Two discharge ports are formed in the bottom of the outside bath 25, and a pipe 32 is connected to these discharge ports. A pump 31 is disposed between the pipe 32 and the injection tube 29. A tank (not shown) which accommodates the plating solution is connected to the pipe 32 via a pump and a valve, and the pump is operated and the valve is opened to supply the plating solution from the tank to the plating solution bath 24.

Meanwhile, the wafer holding unit 17 for holding the wafer 21 is disposed just above the center of the plating solution bath 24 in the second processing portion. The wafer holding unit 17 is suspended from a motor 14 which rotates the wafer 21 together with the wafer holding unit 17 in a substantially horizontal plane.

The motor 14 is covered with a cover made of a plating solution-resistant material such as a synthetic resin to prevent the entry of a mist resulting from evaporation or spattering of the plating solution into the motor 14.

A beam 13 for supporting the motor 14 is mounted to the exterior of the motor 14. One end of the beam 13 is mounted to the inside wall of the housing 12 via a guide rail 15 so to be movable up and down. The beam 13 is also mounted to the housing 12 via a cylinder 11 which is vertically expandable. This cylinder 11 is driven in such a way that the motor 14 supported by the beam 13 and the wafer holding unit 17 are moved vertically along the guide rail 15 to move up or down the wafer 21.

Specifically, the vertical movement is performed in such a way that the wafer 21 held by the wafer holding unit 17 is vertically moved among a loading/unloading position (I) where conveying is started, a washing position (II) where the plating surface of the wafer 21 is washed with, for example, a washing liquid such as pure water, a spin-dry position (III) where spin-drying to be described later is performed, and a plating position (IV) where a plated layer is formed on the plating surface of the wafer 21. The loading/unloading position (I) and the washing position (II) are located above the plating solution level when the plating solution bath 24 is filled with the plating solution, and the spin-dry position (III) and the plating position (IV) are located below the plating solution level.

The wafer holding unit 17 is formed to have a substantially cylindrical shape and can hold a single wafer 21 substantially level within the wafer holding unit 17. The wafer holding unit 17 has a substantially round opening formed on its bottom so to make it possible to form a plated layer on the plating surface of the wafer 21 which is held within the wafer holding unit 17.

A thin copper film, a so-called seed layer, is previously formed by another device on the plating surface of the wafer 21 which is held by the wafer holding unit 17, and a voltage which is applied to a cathode contact member to be described later is also applied to the plating surface of the wafer 21.

The wafer holding unit 17 is provided with a wafer pushing mechanism 19 and a contact/seal holder 20. The back side of the wafer 21 placed on the wafer holding unit 17 is pushed by the wafer pushing mechanism 19 to insure an electrical contact between the wafer 21 and the contact. The wafer pushing mechanism 19 is disposed to enable to push uniformly the outer edge of the wafer 21 in the circumferential direction and configured to vertically move independent of the wafer holding unit 17.

The contact/seal holder 20 is to push and hold the cathode contact member and a sealing member to be described later against the wafer holding unit 17. The contact/seal holder 20 is disposed in such a way to agree with the circumferential direction of the wafer holding unit 17.

Besides, a vacuum chuck 16 is installed at the center of the wafer holding unit 17 and can move the wafer 21 upward from the bottom of the wafer holding unit 17 when the contacts are washed. The vacuum chuck 16 is configured to be movable vertically independent of the wafer holding unit 17.

The sealing member to be described later is fitted to an edge of the inside opening of the wafer holding unit 17, and the plating solution can be prevented from entering the inside of the wafer holding unit 17 by the sealing member and the aforementioned pushing pressure.

Then, a structure for controlling the atmosphere in the housing 12 will be explained. As explained above, a mist and spray resulting from the plating solution contained in the plating solution bath 24 tend to drift in the processing space of the housing 12. Therefore, the exhaust ports 22 built in the separator are disposed in the first processing portion having the plating solution bath 24 in it and suck out the atmosphere from the first processing portion to prevent the mist and spray from scattering to the second processing portion.

Clean air is taken into the second processing portion through an air intake port 33 which is formed at the top end of the housing 12 and flown down to form a flow of atmosphere discharged through air discharge ports 34 which are formed at the bottom of the second processing portion. This air flow may be circulated (not shown) along the exterior of the housing 12. The mist and spray resulting from the plating solution contained in the plating solution bath 24 are prevented from scattering into the second processing portion by the atmosphere flowing down within the housing 12.

Figure 2:
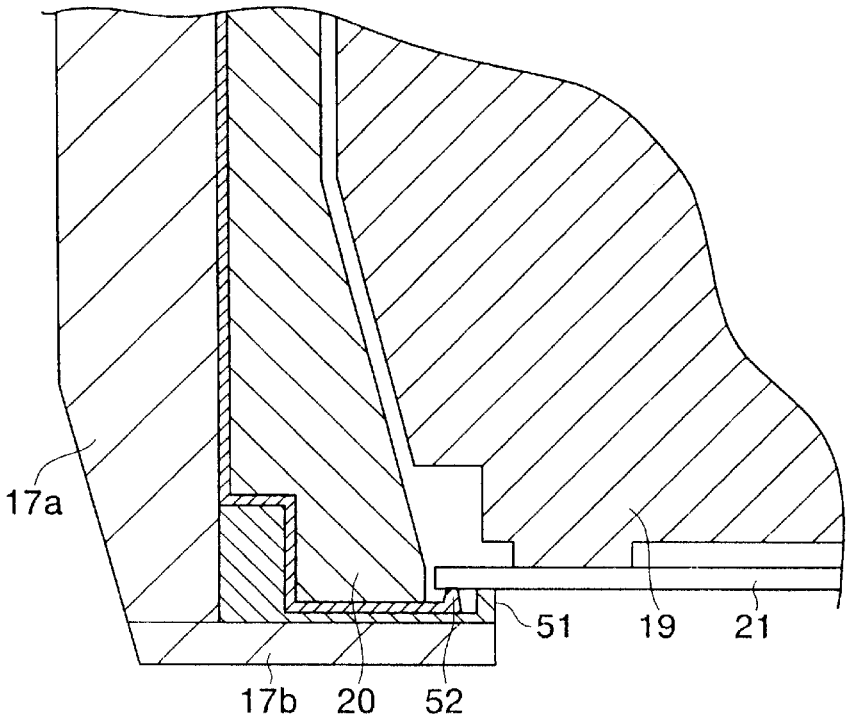
FIG. 2 is a front (partially sectional) view schematically illustrating a state of a wafer 21 mounted on a wafer holding unit 17 shown in FIG. 1.

Then, details of the wafer 21 placed on the wafer holding unit 17 of the plating apparatus will be explained with reference to FIG. 2. FIG. 2 is a schematic front (partially sectional) view for illustrating the wafer 21 placed on the wafer holding unit 17. In FIG. 2, the same reference numerals are used to indicate components which have been described above.

As shown in FIG. 2, the wafer holding unit 17 is comprised of a side member 17*a* and a bottom member 17*b*, and a cathode contact member 52 is disposed within them to apply a voltage to the plating surface of the wafer 21. The cathode contact member 52 is made of a conductive material and comprised of a portion which is formed to have a ring shape in the circumferential direction of the wafer holding unit 17 and a contact point which is protruded from the ring-shaped portion.

The contact point is formed at one point or more of the ring-shaped portion, and preferably at 6 to 180 points. It is because when the wafer 21 has a diameter of, for example, 30 cm and the number of contact points is more than 180, machining tends to be defective in manufacturing. Besides, if it is smaller than the aforementioned range, a plating electric current is hardly distributed uniformly over the plating surface of the wafer 21.

In addition, a lead wire is connected to the cathode contact member 52 in such a way that a voltage can be applied from an unshown external power supply through the lead wire.

Contact portions of the wafer 21 with the contact member 52 are sealed by a sealing member 51 to prevent the plating solution from entering. The sealing member 51 is disposed in the shape of a ring in the circumferential direction of the wafer holding unit 17 and protruded in the shape of a ring in a direction to face the wafer 21. In addition, the sealing member 51 is made of an elastic material such as rubber and elastically deformed to insure a sealing property with the plating surface of the wafer 21 when the back side of the wafer 21 is pushed downward by the wafer pushing mechanism 19.

Figure 3A:
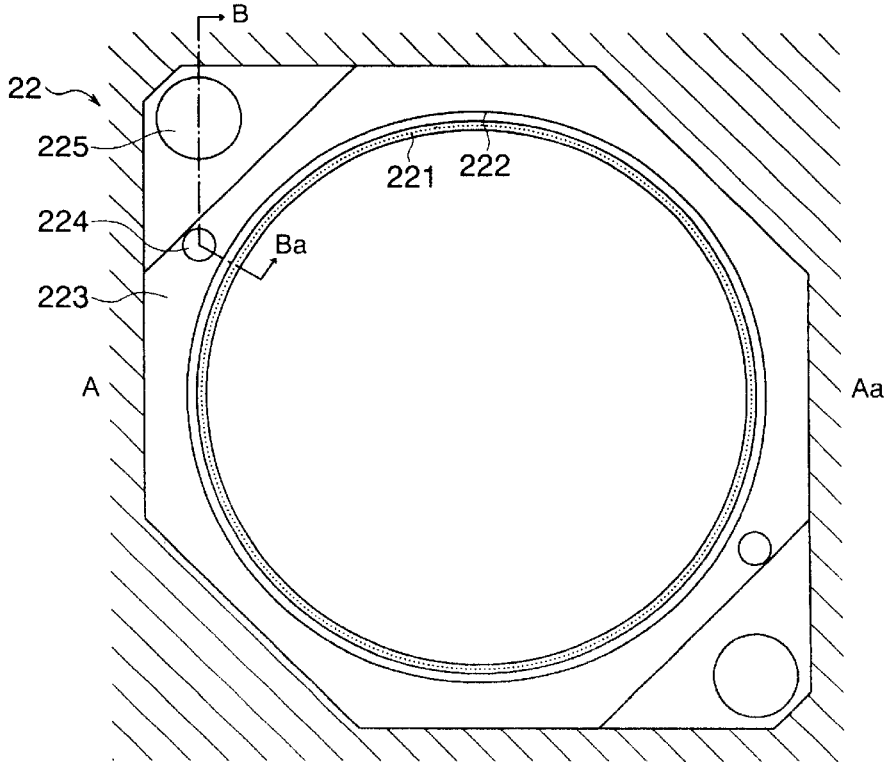
FIG. 3A is a sectional view taken along line A-Aa of the plating apparatus shown in FIG. 1, showing a structure of one embodiment of the mist trap mechanism and mist trap method according to the present invention.
Figure 3B:
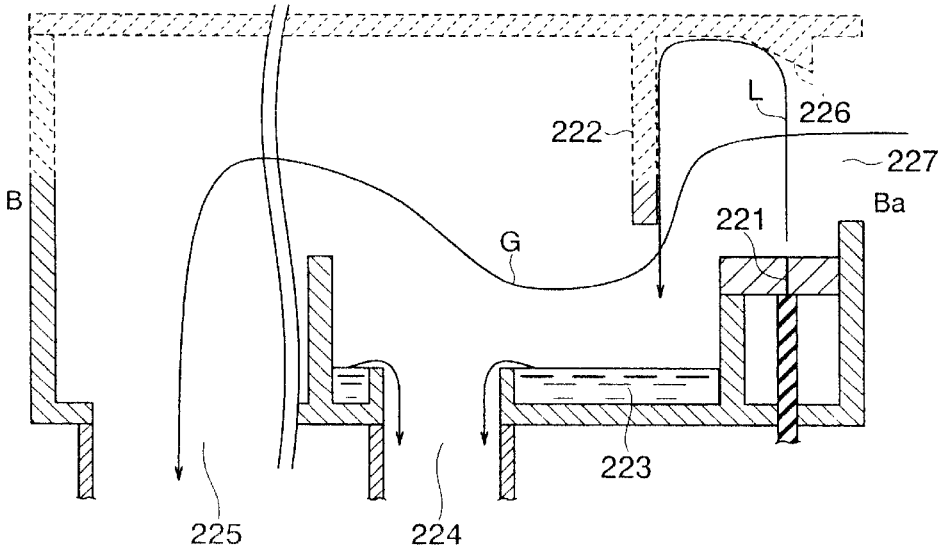
FIG. 3B is a sectional view taken along line B-Bb of FIG. 3A.

Then, the structure of the exhaust ports 22 of the plating apparatus shown in FIG. 1 will be explained with reference to FIG. 3A and FIG. 3B. FIG. 3A is a sectional view taken along line A-Aa of the plating apparatus shown in FIG. 1, showing the structure of one embodiment of the mist trap mechanism and mist trap method according to the present invention. FIG. 3B is a sectional diagram taken along line B-Ba of FIG. 3A. In FIG. 3A, the plating solution bath 24 and its interior, the outside-bath 25, the wafer holding unit 17 and the wafer 21 are omitted from being shown to simplify the illustration.

As shown in FIG. 3A and FIG. 3B, the exhaust port 22 has an opening 227 in an annular shape on the side of the plating solution bath 24, and multiple liquid spouting ports 221 are disposed in an annular shape in the inner part of the opening 227. As shown in FIG. 3B, the liquid spouting ports 221 spout upwardly the liquid (e.g., pure water) in a substantially vertical direction, and its direction is changed deep into the exhaust port 22 by an inclined projection 226. A ring-shaped liquid wall is formed of the liquid spouted by the liquid spouting ports 221.

The liquid spouted by the liquid spouting ports 221 and changed its direction by the inclined projection 226 reaches a solid wall 222 which is formed to suspend, drops along it while wetting its surface, moves as indicated by a mark L in FIG. 3B, and is temporarily held in a liquid receiver 223. The liquid temporarily held in the liquid receiver 223 overflows it and is discharged through a liquid discharge port 224. The solid wall 222 is desired to have properties that its surface tends to get wet with the liquid spouted from the liquid spouting ports 221 and to be made of a material having a corrosion resistant property as described above in view of an efficiency of catching the components of plating solution and its chemical properties.

The atmosphere in the plating apparatus which flows through the opening 227 passes through the exhaust port 22 while colliding with the wall of liquid formed by the liquid spouting ports 221 and the solid wall 222 formed behind the wall of liquid, moves as indicated by a mark G in FIG. 3B and is discharged through a gas discharge port 225. An unshown pump is disposed ahead of the gas discharge port 225 to induce the gas flow.

By the exhaust port 22 configured as described above, the atmosphere to be discharged from the plating apparatus collides with the wall of liquid which is substantially vertically spouted from the liquid spouting ports 221 and also collides with the solid wall 222 whose surface is wet with the liquid. By colliding as described above, the mist and spray of the plating solution contained in the discharge gas can be effectively taken into the liquid. It is because the atmosphere is collided with the wall of liquid and the solid wall which is wet with the liquid by a forced flow of the gas and, as the liquid, a liquid before capturing the mist and spray is supplied sequentially.

For example, according to an experiment which appropriately designs an amount of liquid spouted from the liquid spouting ports 221 and a discharge amount of atmosphere passing through the exhaust ports 22, the above removing effect can provide that the atmosphere with a concentration of plating solution component of 50 $\mu$g/g at the opening 227 can be lowered to about 1/100 or less as a concentration of plating solution after the passage through the gas discharge port 225.

In this embodiment, the mist and the like taken into the liquid can be collectively discharged through the liquid discharge port 224. The liquid discharge port 224 is not required to be disposed in a large number by virtue of the presence of the liquid receiver 223 for holding temporarily.

Thus, this embodiment can dispose the exhaust ports 22 within the separator to effectively improve the effect of removing the mist and the like in the limited space.

The opening 227 and the liquid spouting ports 221 are disposed in the annular shape in this embodiment, but the effect of removing the mist and the like by the collision of the discharge atmosphere with the wall of liquid and the solid wall can be obtained without disposing them in the annular shape (namely, the opening and the liquid spouting ports may be formed as a part of the annular shape).

The liquid receiver 223 is not necessarily required to be disposed, and the liquid discharge port 224 may be disposed in a large number to discharge the liquid without holding it temporarily. The gas discharge port 225 is not limited to be disposed at two positions as shown in FIG. 3A. It may be increased its quantity so to surround the solid wall 222 or may also be one.

The direction of the liquid to be spouted upward by the liquid spouting ports 221 may be slightly inclined toward the inner part of the exhaust port 22. In such a case, the inclined projection 226 is not necessarily required. The direction of the liquid spouted by the liquid spouting ports 221 is not limited to the upward direction but may be in a horizontal direction. In a case where the liquid is spouted in the horizontal direction, the inclined projection 226 is formed at a position to face the ejected liquid to guide its flow to the inner part of the exhaust port 22 so to wet the surface of the solid wall 222. The wall of liquid which is formed of the liquid spouted from the liquid spouting ports 221 is not necessarily required to have continuity to form the wall not having a gap. The liquid spouting ports 221 may be arranged in such a way that the wall of liquid formed of respective streams of spouted liquid has gaps. It is because the discharge atmosphere can be collided with the wall of liquid and the solid wall even if there are gaps.

It is to be understood that the present invention is not limited to the particular embodiments described with reference to the drawings but all modifications that fall within the scope of the accompanying claims can be embraced by the invention.

What is claimed is:

1. A mist trap mechanism for a plating apparatus, comprising:

a gas discharge passage which runs from a space in a plating chamber to a space outside the plating chamber;

a liquid spouting portion which is disposed in the gas discharge passage and spouts a liquid to be collided with a stream of gas being discharged;

a solid wall which is disposed in the gas discharge passage in such a way that its surface gets wet with the spouted liquid and the wet surface collides with the stream of discharge gas; and a liquid recovery portion which is disposed in connection with the gas discharge passage and recovers the spouted liquid, the liquid collided with the stream of gas and the liquid having wetted the surface of the solid wall.

2. The mist trap mechanism for a plating apparatus according to claim 1, wherein the liquid spouting portion spouts pure water as the spouted liquid.

3. The mist trap mechanism for a plating apparatus according to claim 1, wherein the gas discharge passage comprises an opening having an annular shape to face the space in the plating chamber, and wherein the liquid spouting portion is disposed to form an annular wall of liquid by the spouted liquid at an inner part of the annular opening of the gas discharge passage.

4. The mist trap mechanism for a plating apparatus according to claim 1, wherein the liquid recovery portion comprises; a liquid storing portion which collectively temporarily stores the spouted liquid, the liquid collided with the gas stream and the liquid having wetted the surface of the solid wall; and a liquid discharge pipe which discharges the temporarily stored liquid when it overflows.

5. The mist trap mechanism for a plating apparatus according to claim 1, wherein the surface of the solid wall, which gets wet with the spouted liquid, comprising any material of PET, PVC, PEEK, or PVDF.

6. A mist trapping method for a plating apparatus comprising:

discharging a gas from a space in a plating chamber to a space outside the plating chamber through a gas discharge passage;

colliding the liquid spouted from a liquid spouting portion, which is disposed in the gas discharge passage, with a stream of discharge gas;

colliding the stream of discharge gas with a solid wall which is disposed in the gas discharge passage and has its surface wetted with the spouted liquid; and recovering the spouted liquid, the liquid collided with the stream of gas and the liquid having wetted the surface of the solid wall.

* * * * *